US006071084A

United States Patent [19]

Wass et al.

[11] Patent Number: 6,071,084

[45] Date of Patent: Jun. 6, 2000

[54] ASPIRATOR

[76] Inventors: Lloyd G. Wass, 1670 Blackhawk Cove, Eagan, Minn. 55122; Kurt Drewelow, Rt. 2-Box 1016, Aitkin, Minn. 56431; Robert Venne, 509 First St. SW., Crosby, Minn. 56441; Alan Bohlig, 10865 Hyland Ter., Eden Prairie, Minn. 55344

[21] Appl. No.: 09/037,200

[22] Filed: Mar. 9, 1998

Related U.S. Application Data

[63] Continuation-in-part of application No. 08/557,850, Nov. 14, 1995.

[51] Int. Cl.[7] ..... F04F 5/48

[52] U.S. Cl. ..... 417/187; 417/189; 137/888

[58] Field of Search ..... 417/151, 171, 417/179, 181–184, 189; 137/604, 895

[56] References Cited

U.S. PATENT DOCUMENTS

| | | | |
|---|---|---|---|
| 3,591,314 | 7/1971 | Day | 417/49 |
| 3,598,504 | 8/1971 | Siravo | 417/184 |
| 3,684,404 | 8/1972 | Galbraith | 417/184 |
| 4,368,009 | 1/1983 | Heimovics, Jr. et al. | 417/191 |
| 4,566,862 | 1/1986 | Halavais | 417/189 |
| 4,592,349 | 6/1986 | Bird | 128/204.25 |
| 5,002,465 | 3/1991 | Lagen et al. | 417/182 |

*Primary Examiner*—Teresa Walberg
*Assistant Examiner*—Thor Campbell
*Attorney, Agent, or Firm*—John M. Vasuta

[57] ABSTRACT

An aspirator for inflating inflatable devices such as aircraft emergency evacuation slides and life rafts using a quantity of primary gas that is stored in a tank that within the aspirator entrains a secondary gas, typically outside air, as the primary gas flows through the aspirator thereby producing sufficient gas to inflate a large inflatable structure or device as described above. The aspirator typically has injectors therein which act to promote the entrainment of large quantities of the secondary fluid using small quantities of the primary fluid thereby resulting in a large combined flow of gas forcibly flowing into the inflatable structure.

20 Claims, 14 Drawing Sheets

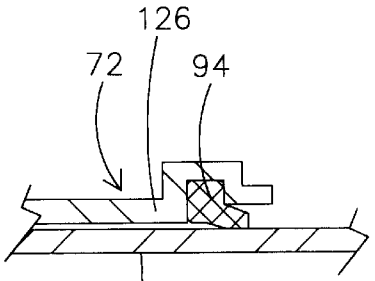
Fig-8A
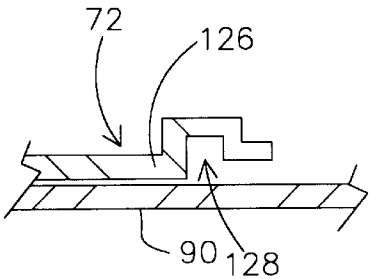
Fig-8B
Fig-8C
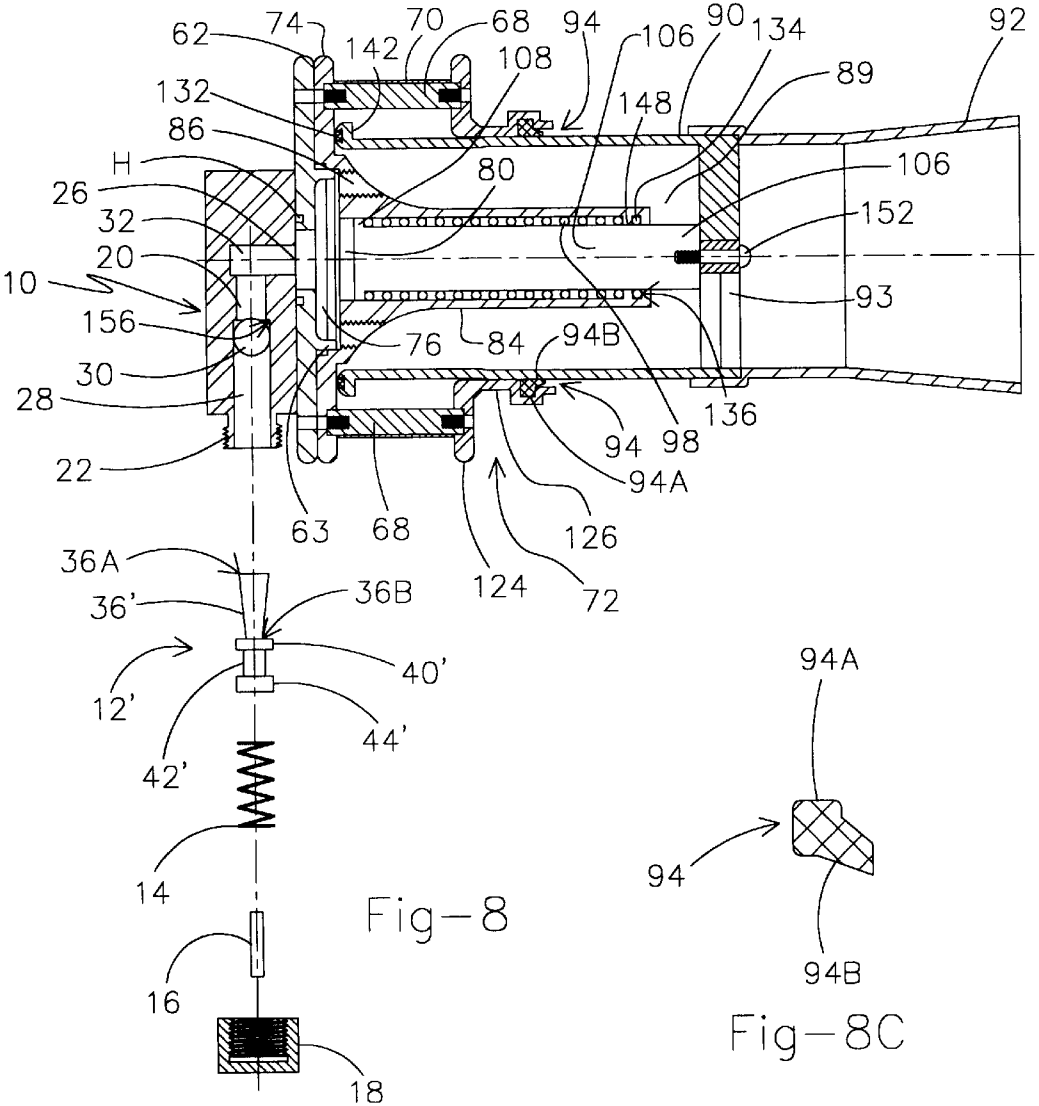
Fig-8

ASPIRATOR

CROSS REFERENCE TO RELATED APPLICATION

This application is a continuation-in-part application that is related to and claims priority from co-pending U.S. patent application Ser. No. 08/557,850 filed on Nov. 14, 1995.

BACKGROUND OF THE INVENTION

The subject invention is directed to fluid inflation apparatus, and more specifically to aspirators for inflating inflatable devices such as aircraft emergency evacuation slides, life rafts, and other similar devices requiring rapid inflation.

Numerous inflation apparatus for inflating inflatable devices such as slides and rafts are known in the art. Basically, these systems inflate inflatable structures using a quantity of primary gas that is stored in a tank, in combination with a mass flow aspirator that entrains secondary gas, typically outside air, as the primary gas flows through the mass flow aspirator thereby producing sufficient gas to inflate a large inflatable structure or device such as an aircraft slide or life raft. The aspirator typically has injectors therein which act to entrain large quantities of a secondary fluid using small quantities of a primary fluid thereby resulting in a large combined flow of gas forcibly flowing into the inflatable structure.

Efficiency of the primary gas in entraining large quantities of a secondary gas is important since the greater the efficiency the lesser the quantity of primary gas needed. Since aspirators are typically used to inflate devices that must be stored in small areas such as on airplanes and boats (for air slides and life rafts), it is therefore desirable to have the highest efficiency possible which results in the smallest primary gas tank.

Many different types of aspirators are known in the prior art. These aspirators are satisfactory to a greater or lesser degree but often have certain inefficiencies or design configurations which make them unreliable, inefficient or difficult to manufacture, apt to leak, subject to leaks from debris ingestion or inconvenient or bulky to package. It is, accordingly, a primary object of the subject invention to provide an aspirator that is highly efficient, does not leak, is simple and efficient to manufacture, is sufficiently small to be easily storable on aircraft and watercraft, and is simple and efficient to manufacture.

SUMMARY OF THE INVENTION

In accordance with one aspect of the invention, there is provided an aspirator for inflating inflatable devices generally comprising a more efficient entrainment of a secondary fluid with the primary fluid during aspiration, and more efficient sealing of the telescoping mixing tube to the base it slides within. Specifically, the telescopic mixing tube slides within a base in which entrainment occurs. A regulator mechanism regulates the flow of inflation medium during aspiration. Various seals are in place along the inflation medium and aspiration medium flow paths to assure the mediums do not leak out of the aspirator and thereby more efficiently inflate the inflatable device.

Of these various seals, the wiper seal is critical as its efficiency directly affects the entrainment efficiency and thus the quantity of primary fluid needed. It is also critical to post-aspiration sealing. It has been found that a reclined L-shaped wiper seal or, even more preferably, a U-shaped wiper seal provides significantly improved sealing. In conjunction with the criticality of the shape of the wiper seal, it has further been found that by providing a non-uniform tube such as one with a taper along the interaction path of the tube and the wiper seal results in wider sealing ranges as well as significantly improved sealing and thus entrainment. This tapering requires less friction to move the tube during entrainment when the tapering is properly defined so as to not effect sealing when the tube is closed after the inflatable device has been inflated.

In addition, the design of the regulator mechanism and specifically the regulator piston therein is also critical as it controls primary gas flow and thus entrainment. It has been found that an inverted tapered head provides superior fluid flow to a prior art cylindrical head, and that a stepped taper is most efficient.

It has further been found that the design of the aspirator assembly and specifically the aspirator piston is also critical to flow and entrainment. It has been found that a double piston, or a piston within a piston, design further assists in providing improved efficiency during entrainment.

The arrangement described above allows for quick and efficient inflation of an inflatable device. The telescoping tube allows the overall dimensions of the device to be decreased thus providing a compact device that is extendable only during operation when a longer draft tube is needed.

The arrangement described above also allows more efficient inflation by improved sealing of the inflation and aspiration medium paths to provide the most possible inflation and aspiration medium to the inflatable device. This decreases the required size of the inflation medium supply due to the more efficient aspiration.

In accordance with another aspect, the telescopic tube sealing also prohibits deflation of the inflated device after aspiration is complete.

In accordance with yet another aspect, the described aspirator has a sloped/tapered regulator piston to more smoothly deliver inflation medium which initially may be under several thousand pounds per square inch of pressure but will steadily decrease as the supply is used up to several hundred or less. The sloped regulator with intermediate neck portions provides a better flow.

The arrangement described above further allows for more efficient inflation of an inflatable device by providing controlled air flow through the regulator based upon the sloped or tapered piston design.

The arrangement even further provides for more efficient and smooth inflation of an inflatable device based upon the aspirator piston of a multiple part piston construction.

The arrangement also provides for significantly smoother telescoping of the tube as well as better sealing of the outer container and telescoping tube to the inflatable device.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, preferred alternative embodiments and methods of which will be described in detail in this specification and illustrated in the accompanying drawings which form a part hereof, and wherein:

FIG. 8 is a cross-sectional view of the aspirator body with the regulator mechanism exploded therefrom and with a second embodiment of the piston shown and the injectors and poppet removed for clarity;

FIG. 8A is an enlarged cross sectional view of the wiper annular ring mounting groove as shown in FIG. 8 with the annular ring therein;

FIG. 8B is an enlarged cross sectional view as in FIG. 8A except the annular ring is removed from the groove;

FIG. 8C is an enlarged cross sectional view of the wiper annular ring as shown in FIG. 8A;

DETAILED DESCRIPTION OF THE PREFERRED EMBODIMENT

Figure 1:
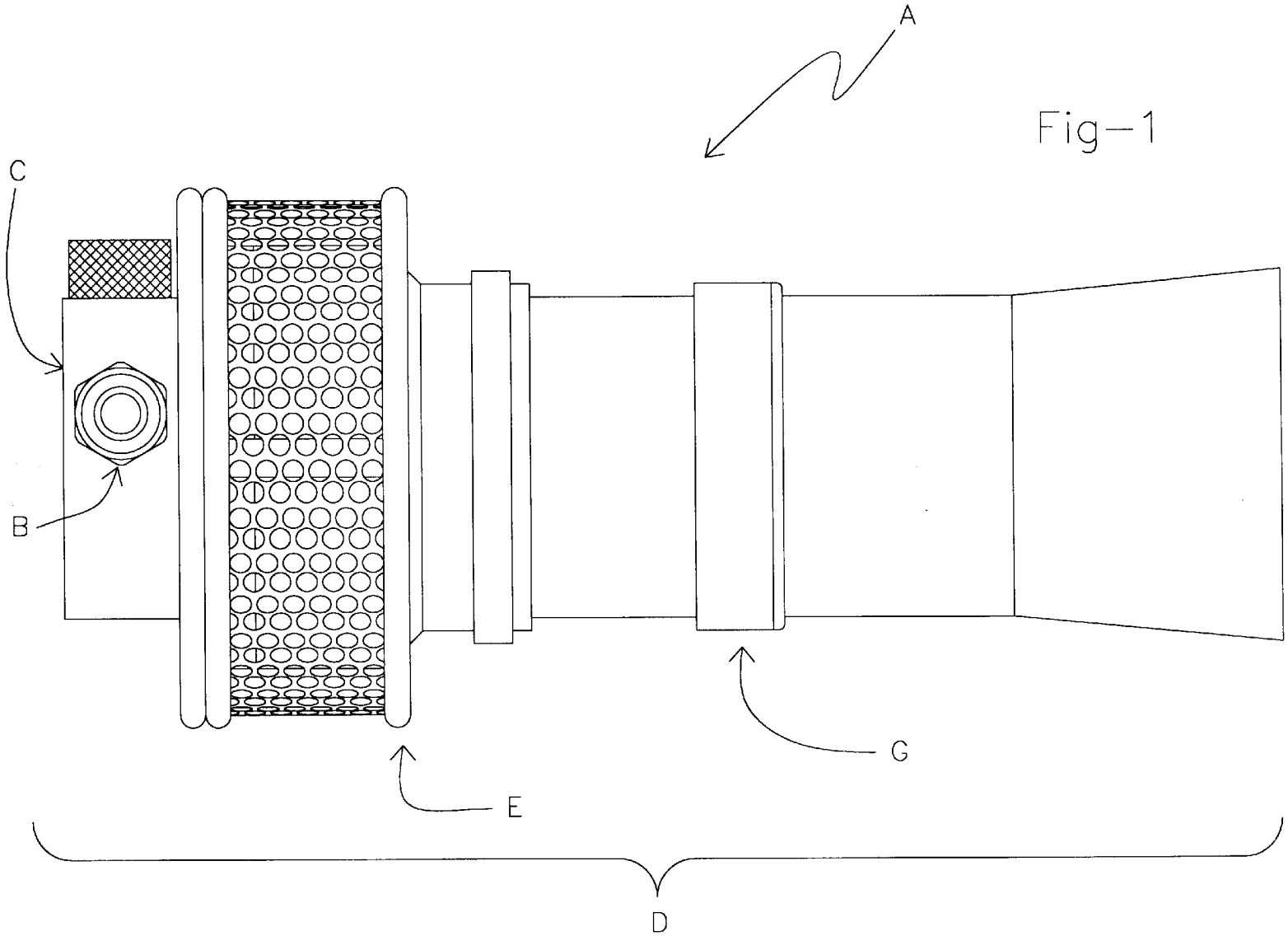
FIG. 1 is a side perspective view of a preferred embodiment of an aspirator in the closed (or stored) position for use in inflating inflatable devices.
Figure 2:
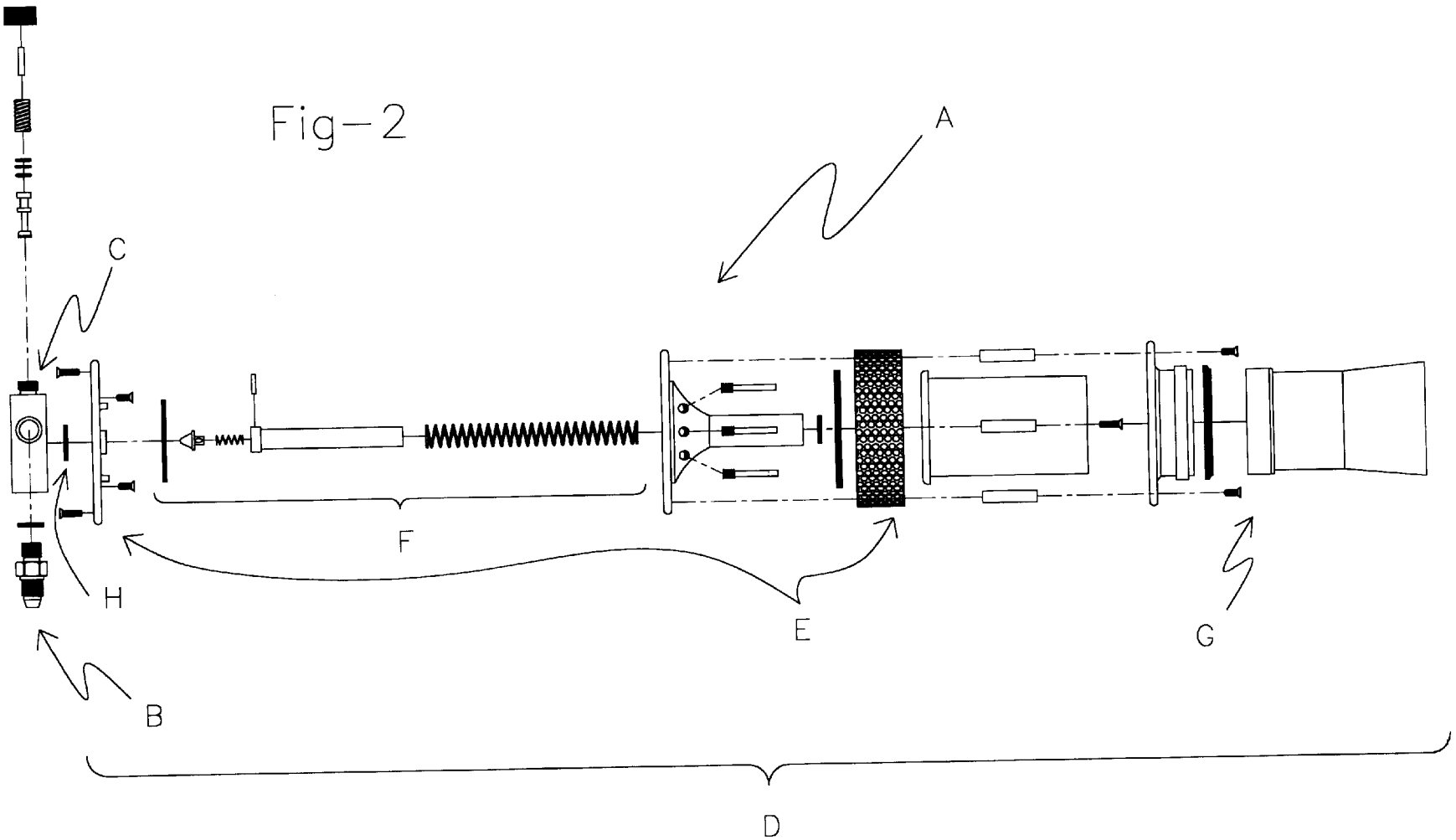
FIG. 2 is an exploded view of the complete aspirator assembly of FIG. 1 with a first embodiment of a piston therein (note: the inlet fitting threads in and out of the page (vertical) but is shown following the dashed lines downward on the page for clarity)

Referring now to the drawings wherein the showings are for the purposes of illustrating various embodiments of the invention only and not for purposes of limiting same, the overall arrangement of one construction of the aspirator assembly A can best be understood by reference to FIG. 1 showing an overall perspective view and FIG. 2 showing an exploded view. As illustrated therein, the aspirator assembly A comprises an inflation medium inlet B, a regulator mechanism C that regulates the flow of inflation medium, also referred to as a primary fluid, and an aspirator body D where the inflation medium combines with an aspirated medium, also referred to as a secondary or entrained fluid, to inflate the desired inflatable device. As shown more clearly with reference to FIGS. 2, 4, 5, and 6A–6B aspirator body D comprises a base E having an aspirator piston assembly F therein, and a mixing tube assembly G. The aspirator assembly A is generally formed by securing mixing tube assembly G within base E, and connecting it to regulator mechanism C and inflation medium inlet B. The overall entrainment process can best be understood by reference to FIGS. 8, 9 and 10.

As shown more clearly in the exploded view in FIG. 2, aspirator assembly A comprises inflation medium inlet B, which is connectable to an inflation medium supply such as a tank in one embodiment, connected to regulator mechanism C (shown in detail in FIG. 3) which in turn is connected to base E of aspirator body D (shown in detail in FIGS. 4 and 5) which comprises mixing tube assembly G connected to base E. An inflatable device is fluidly connectable to base E. When inflation of the inflation device is desired, the inflation medium in the inflation medium supply is released and flows through regulator mechanism C and into base E where an aspiration medium, typically air from the atmosphere, is suctioned or pulled (aspirated) into the flow path and entrained therein. The flow of both the pressure driven inflation medium and the aspirated medium continues as it escapes the aspirator assembly A to a lower pressure area through mixing tube assembly G thereby inflating the inflation device fluidly connected to base E. Regulator mechanism C regulates inflation medium flow into base E and mixing tube assembly G.

Figure 9:
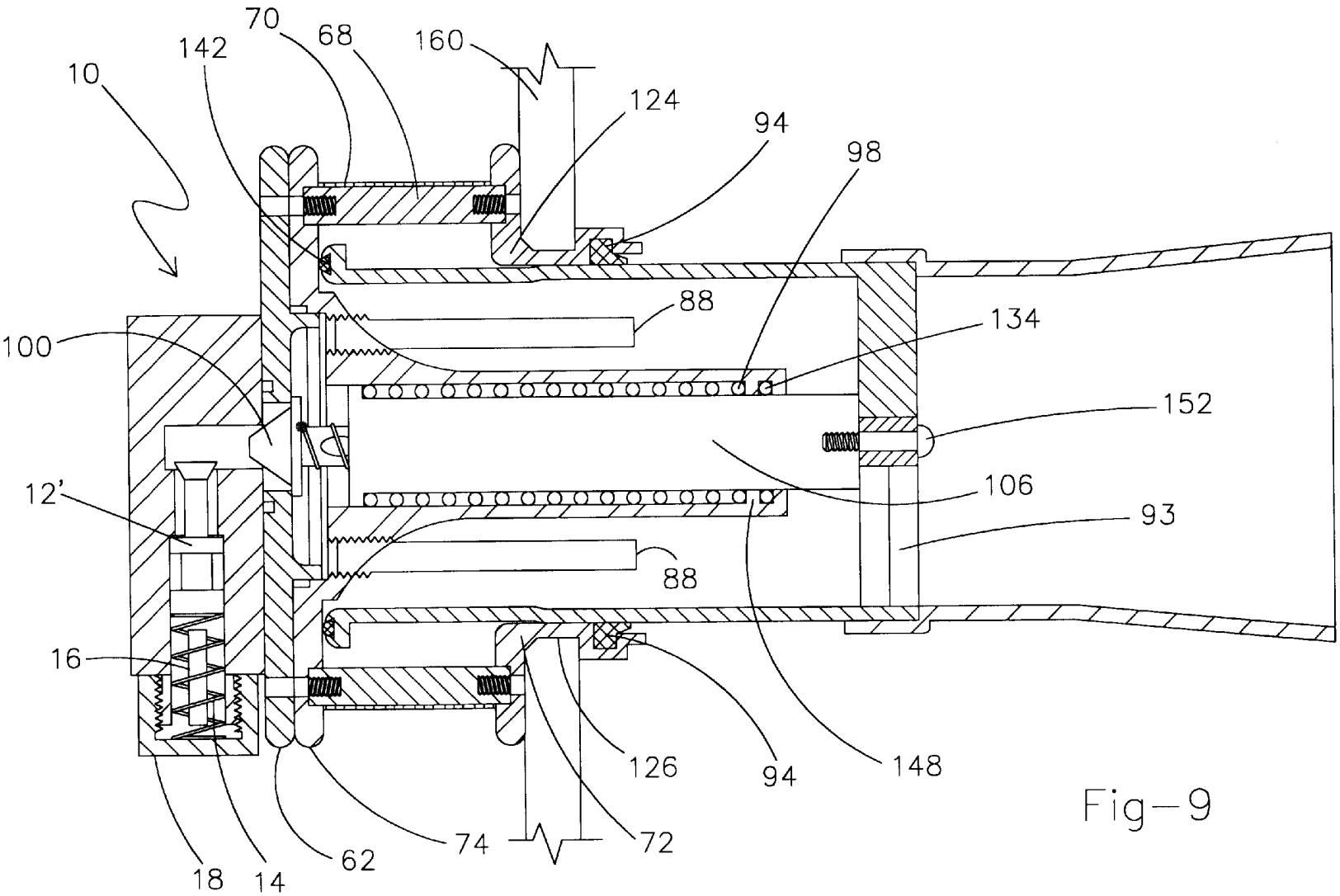
FIG. 9 is a cross sectional view of the aspirator assembly fully assembled in a closed (i.e., non-aspirating) position.
Figure 10:
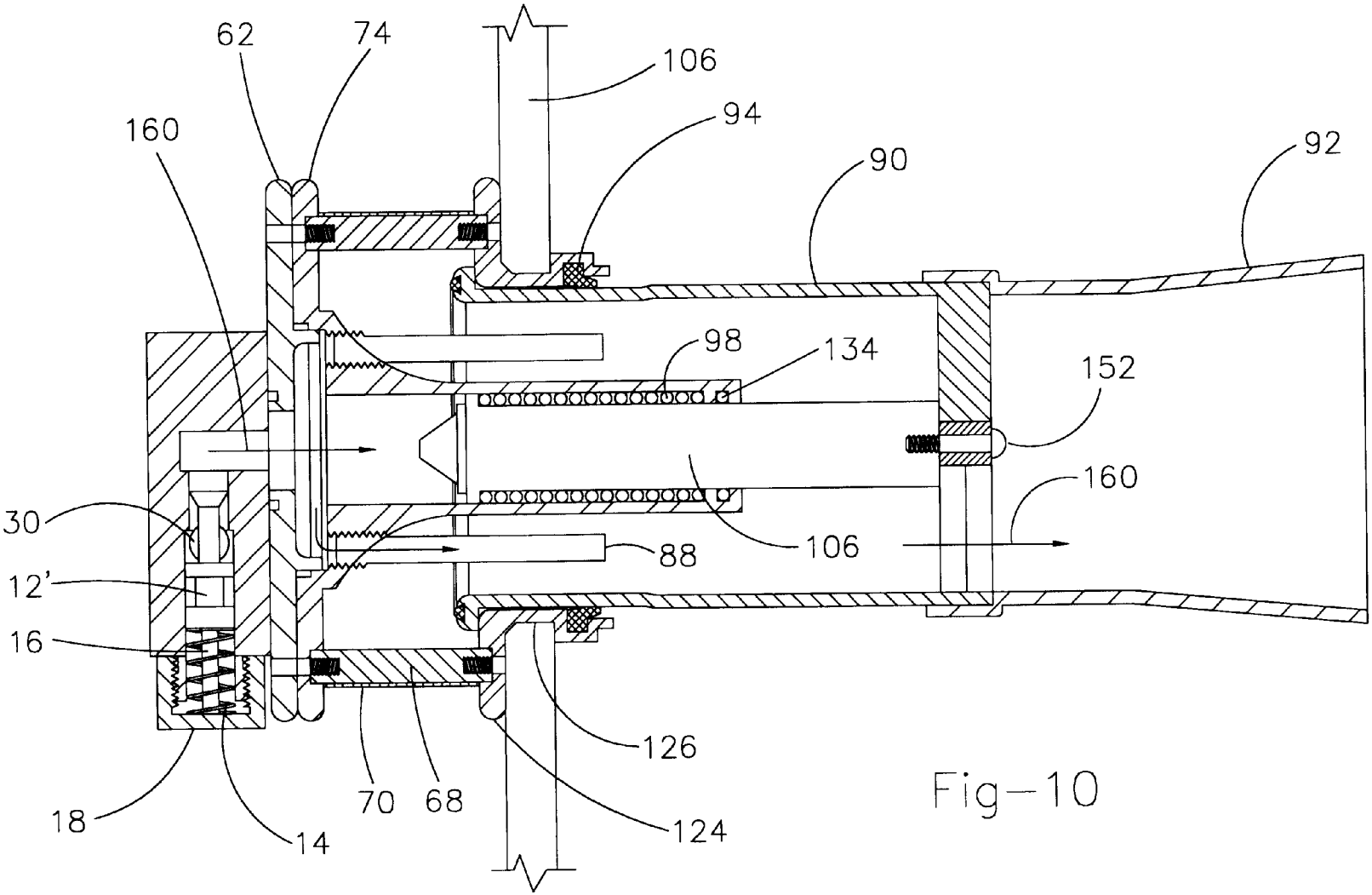
FIG. 10 is a cross-sectional view similar to FIG. 9 but showing the aspirator open (i.e., aspirating)
Figure 11:
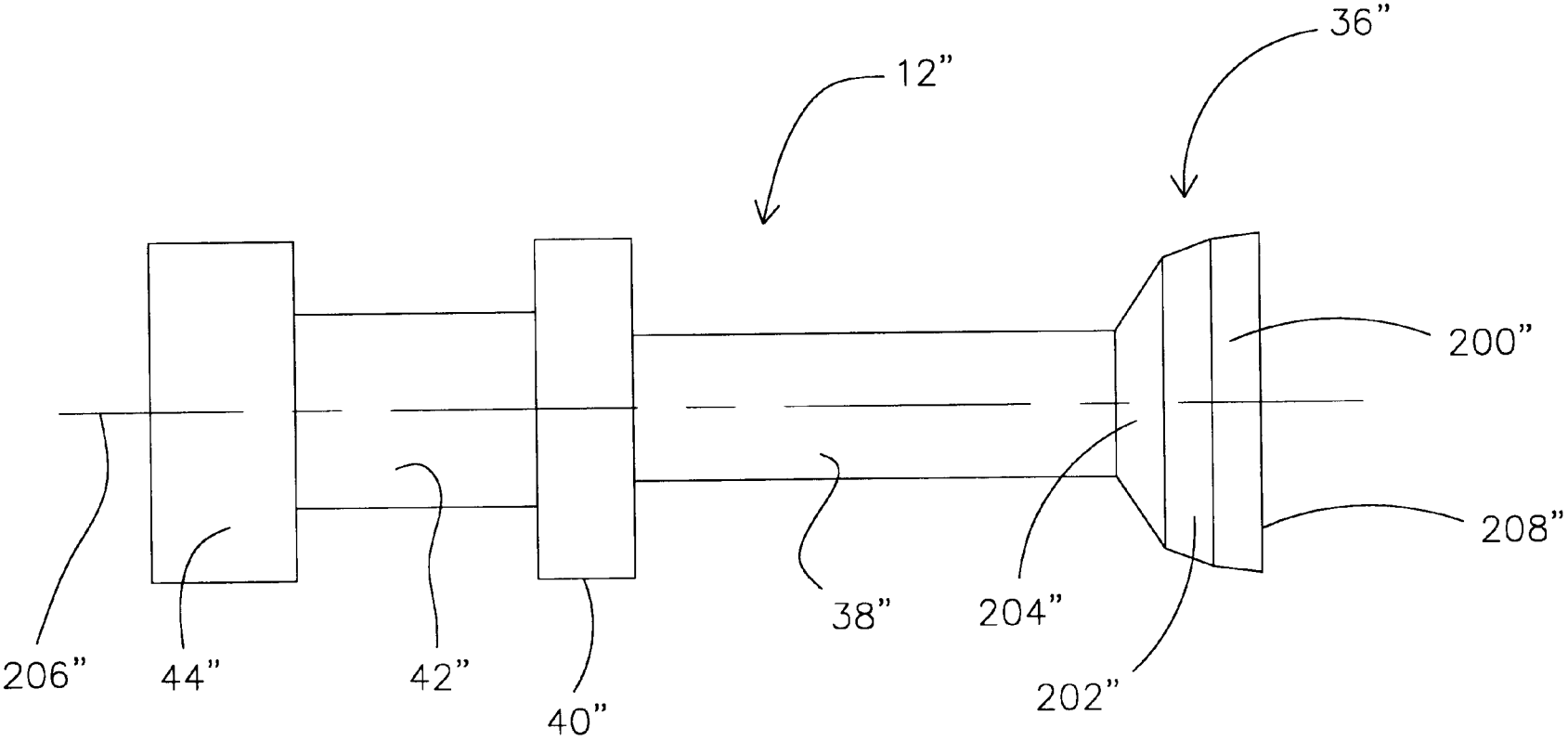
FIG. 11 is a third embodiment of a regulator piston for use in the regulator mechanism.

Specifically, multiple embodiments of regulator mechanism C are contemplated with a first embodiment best shown in FIGS. 2–3, 6A and 6B, a second embodiment best shown in FIGS. 8–10, and a third embodiment best shown in FIG. 11. The first embodiment of regulator mechanism C is shown in detail in FIGS. 2 and 3 comprising the following five main parts: a regulator body 10, a regulator piston 12, a regulator spring 14, a regulator post 16, and a regulator cap 18. Regulator body 10 has an inner cavity 20 with a threaded regulator port 22, a threaded inlet port 24, and an outlet port 26. Inner cavity 20, as is shown in more detail in FIGS. 7A, 7B and 7C, comprises a regulator passageway 28, an inlet passageway 30, and an outlet passageway 32. Inlet passageway 30 and outlet passageway 32 each intersect regulator passageway 28 in the approximate middle of the regulator body 10 creating the inner cavity 20 where the inlet passageway 30, regulator passageway 28 and the outlet passageway 32 intersect.

Figure 7B:
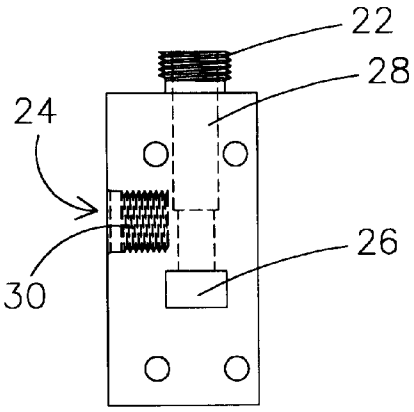
FIG. 7B is a side perspective view with inner cavities shown in shadow of the regulator body as shown in FIG. 7A turned ninety degrees.
Figure 7A:
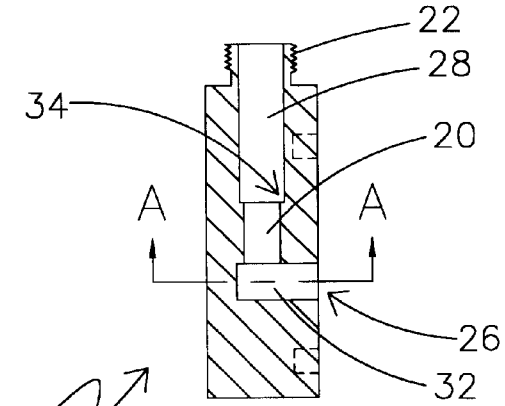
FIG. 7A is a side sectional view of the regulator body from the same view as in FIG. 1.
Figure 7C:
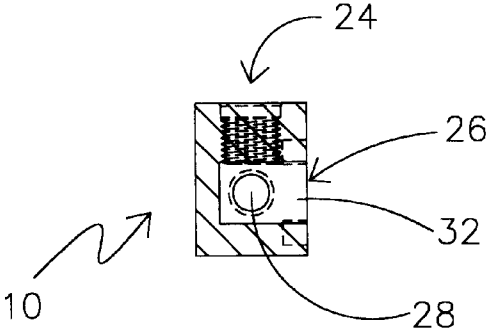
FIG. 7C is a bottom sectional view cut along line A—A in FIG. 7A.

Regulator passageway 28 extends from this inner cavity 20 to regulator port 22. The preferred embodiment of regulator port 22 is a male threaded, outwardly extending, generally cylindrical adaptor having an aperture in the center thereof that is fluidly connected to the regulator passageway 28. The regulator port 22 is adapted for threadably receiving internally threaded regulator cap 18. As shown in FIGS. 7A, 7B and 7C, the regulator passageway 28 typically has a restriction flange or seat 34 therein for prohibiting regulator piston 12 from passing further into inner cavity 20 than seat 34 when inserted into regulator port 22.

Referring back to FIG. 3, regulator post 16 is positioned in between regulator cap 18 and regulator piston 12. In one embodiment, post 16 is a cylindrical post that acts as a stop and sets a minimum separation distance between regulator cap 18 and regulator piston 12. Alternatively, post 16 may be any means that acts to minimally separate piston 12 from cap 18.

Figure 3:
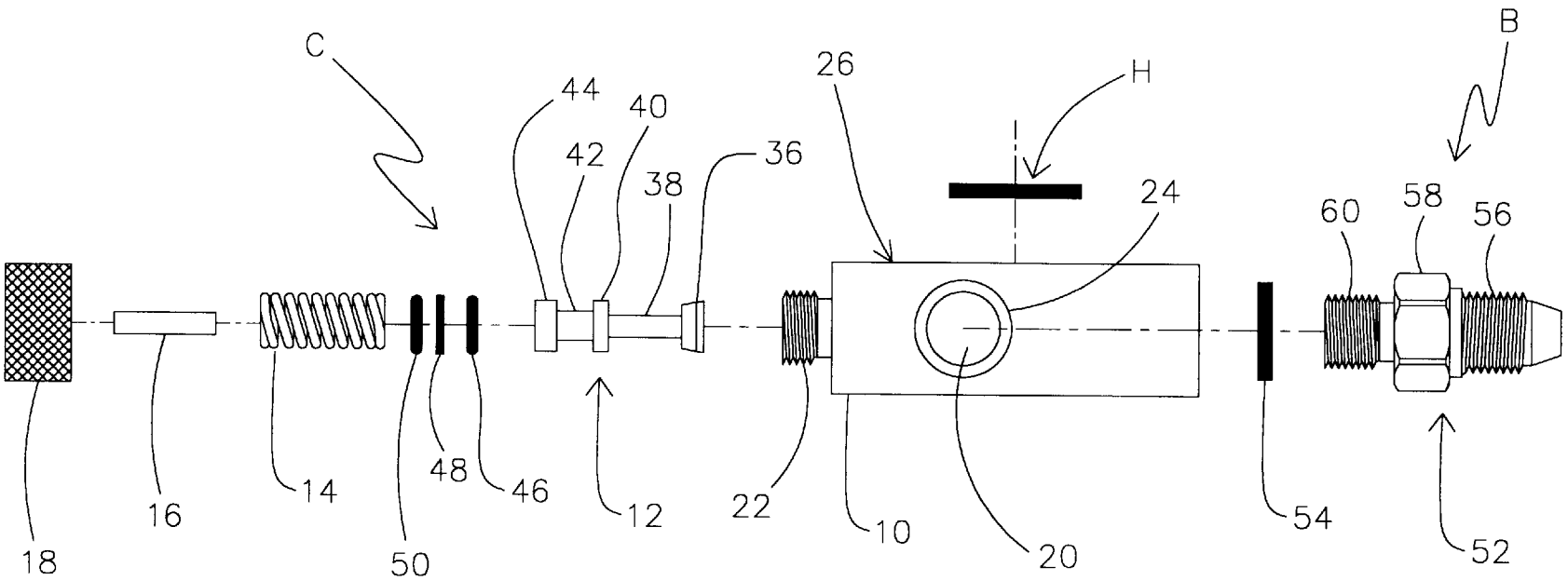
FIG. 3 is an exploded view of the regulator and inlet subassemblies of the aspirator assembly of FIG. 1 (See note in FIG. 2)
Figure 6A:
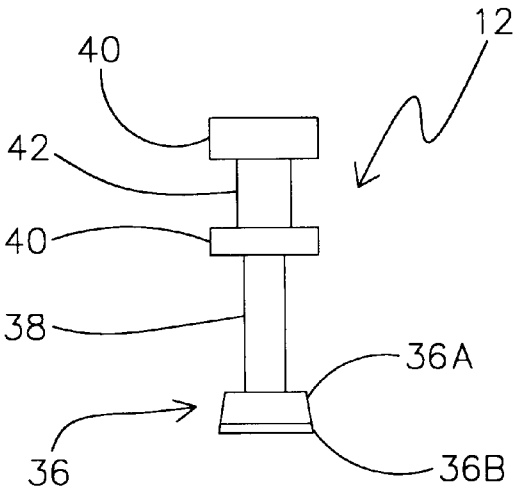
FIG. 6A is a side perspective view of a first embodiment of the piston.
Figure 6B:
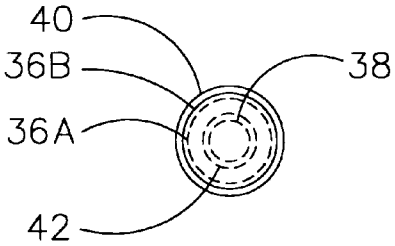
FIG. 6B is a bottom perspective view of the first embodiment of the piston as shown in FIG. 6A.

Regulator piston 12, as is shown in FIG. 3 and in more detail in FIGS. 6A and 6B, has a head or upper flange 36, a first neck 38, an intermediate flange 40, a second neck 42, and a base or lower flange 44. In addition, base 44 in an alternative embodiment may include a seat in its end for receiving one end of regulatory post 16. Flange 40 and base 42 have a larger diameter than the maximum diameter of head 36 which is sloped or conical as is more clearly shown in FIG. 6A. Specifically, head 36 has a first or inner end 36A and a second or outer end 36B where the diameter of the first end is less than the diameter of the second end thereby conically defining the head 36. This conical shape assists in the balancing of inflation medium flow from the highest pressure flow at the beginning of aspiration to the lowest pressure flow near the completion of aspiration.

Regulator mechanism C also includes head annular ring 46, backup annular ring 48, and flange annular ring 50 for sealing movable piston 12 within the regulator passageway 28. All three of these annular rings 46, 48, and 50 are positioned within first neck 38 between intermediate flange 40 and base 44. In one embodiment, these annular rings are o-rings.

An alternative embodiment of regulator piston 12 is shown in FIG. 8 as 12' which also shows in section the aspirator body D assembled with the regulator mechanism C exploded therefrom. The piston in this alternative embodiment has a head 36', an intermediate flange 40', a second neck 42', and a base 44', but does not have the first neck 38 that the preferred embodiment has. Instead, head 36', which still has a first or inner end 36A with a smaller diameter than that of a second or outer end 36B, extends in decreasing diameter to the intermediate flange 40'.

Referring again to FIG. 3, regulator cap 18 has a threaded bore for threading the cap to regulatory port 22. The bore receives regulator post 16 and regulator spring 14, and in one embodiment the bore includes a seat for receiving and holding spring 14 therein. Alternatively or in addition, the bore may include another seat for receiving and holding post 16 (the opposite end as is seated in base 44 or 44') therein.

As is shown in FIG. 9, regulator piston 12 or 12', regulator spring 14, and regulator post 16 are positioned in regulator passageway 28 where regulator cap 18 holds regulator piston 12 or 12', regulator spring 14, and regulator post 16 within regulator passageway 28. Regulator spring 14, when the cap 18 is threaded onto regulator port 22 thereby holding the piston 12 or 12', spring 14, and cap 18 in the passageway, biases piston 12 or 12' away from cap 18 and further into the inner cavity 20 (toward and eventually into contact with restriction seat 34).

When fluid pressure within the inner cavity 20 exceeds the tension in regulator spring 14 then the spring is compressed resulting in regulator piston 12 or 12' being forced toward cap 18. A maximum compression of spring 14 is reached if sufficient fluid pressure is presented to force piston 12 or 12' into contact with post 16 and post 16 into contact with cap 18 since post 16 acts as a stop and prohibits further compression and this is shown in FIG. 10 and described in more detail later.

FIGS. 7B and 7C show inlet passageway 30 extending from inner cavity 20 to threaded inlet port 24. The preferred embodiment of inlet port 24 is shown in FIGS. 2, 3, 7B, and 7C as a female threaded, inwardly extending, generally cylindrical hole adapted to receive inflation medium inlet B which comprises an inlet fitting 52 and an annular ring 54, which in one embodiment is of an o-ring configuration. Inlet fitting 52 as is shown in FIGS. 1, 2, and 3 in its preferred embodiment has a flared threaded end 56 for connecting to an inflation medium supply, a center nut 58, and a male threaded end 60 threadably connected to threaded inlet port 24. When end 60 is tightly threaded in port 24, annular ring 54 is compressed in between center nut 58 and regulatory body 10. Annular ring 54 seals the connection of end 60 to regulatory body 10 from inflation medium leakage.

Outlet passageway 32 extends from inner cavity 20 to outlet port 26. In a preferred embodiment as is shown in detail in FIGS. 7A and 7C, outlet port 26 is a non-threaded A aperture through which the inflation medium flows during the inflation of an inflatable device. The inflation medium flows from an inflation medium supply through inlet fitting 52, inlet passageway 30, inner cavity 20, outlet passageway 32, and outlet port 26, respectively, to aspirator body D where the inflation medium aspirates aspirated medium into the flow and the combined flow inflates an inflatable device. Outlet passageway 32 is sealed to aspirator body D by a seal H as is shown in FIG. 2 when fasteners 144 connect regulator mechanism C to aspirator body D.

Figure 4:
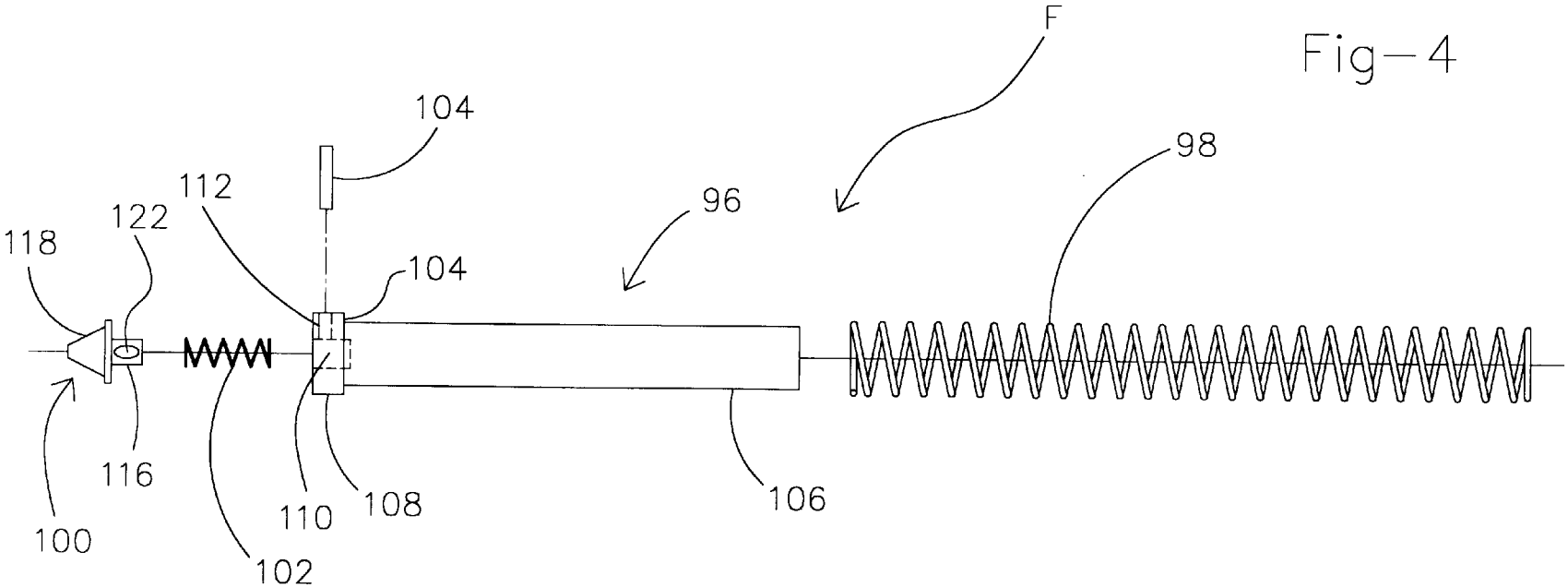
FIG. 4 is an exploded view of the aspirator piston assembly of the aspirator assembly of FIG. 1.
Figure 5:
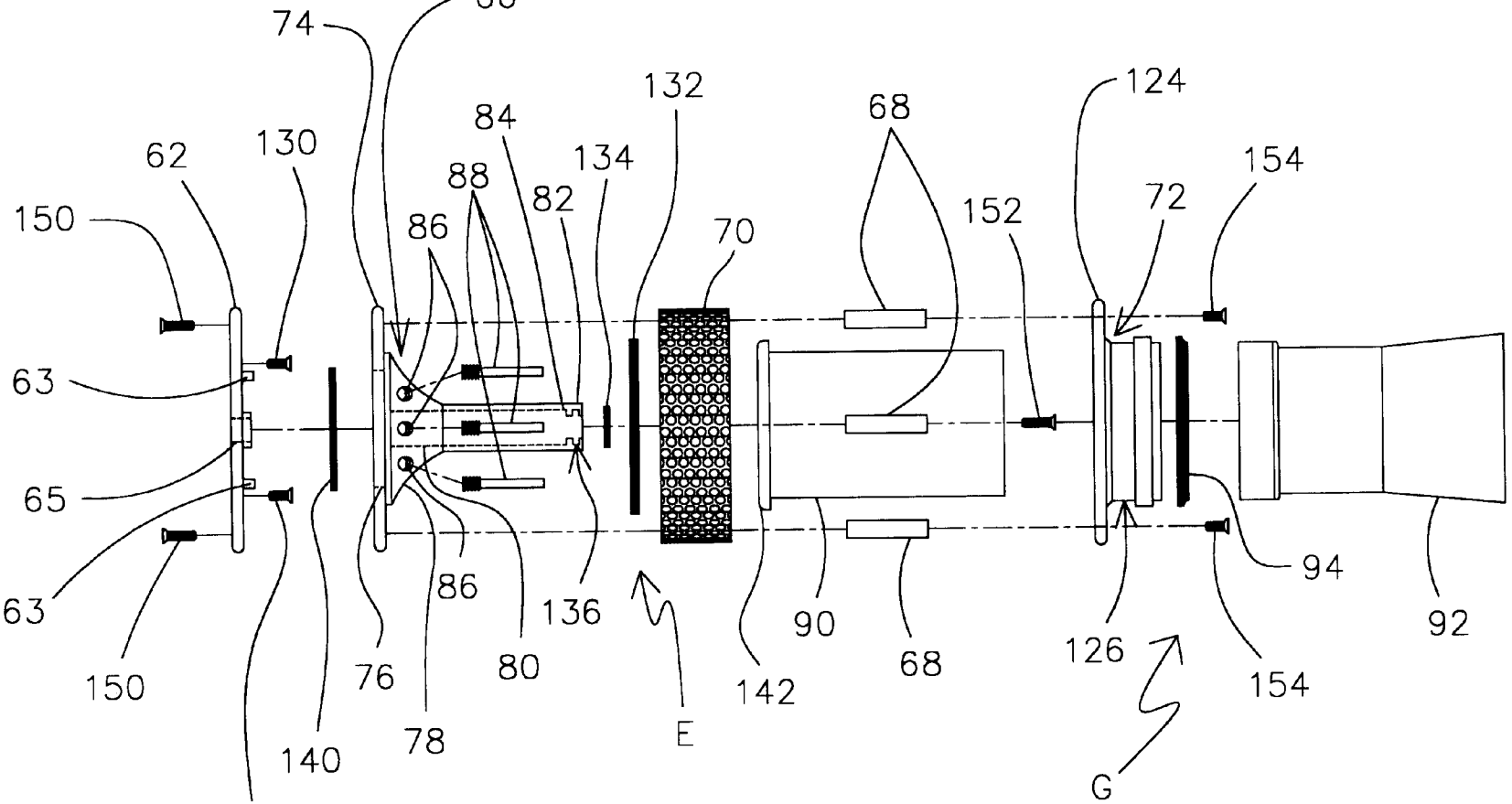
FIG. 5 is an exploded view of the aspirator body of the aspirator assembly of FIG. 1.

Aspirator body D as is shown in FIGS. 2, 4, and 5 comprises mixing tube assembly G mounted to base E. In a preferred embodiment, base E includes an aspirator cap 62 with a poppet head seat 64 thereon having a cap aperture 65 (shown in hidden lines) therein, an injector body 66, a plurality of support columns 68, a screen 70, an outer container 72, and an aspirator piston assembly F, as is shown in FIG. 4, housed inside. Injector body 66 is an injector plate 74 with a plate aperture 76 (shown in hidden lines) therein for receiving alignment nubs 63 on aspirator cap 62, an injector throat or support 78 with a passageway 80 (shown in hidden lines) therein, and a piston housing 82 with a passageway 84 (shown in hidden lines) therein. Plate aperture 76, passageway 80, and passageway 84 align to form a cavity in which aspirator piston assembly F slides with passageway 84 acting as a guide cylinder.

Injector throat 78 has a plurality of threaded injector apertures 86, each of which in a most preferred embodiment has an injector 88 extending therefrom where the injector extends beyond columns 68 and sufficiently into aspiration cavity 89 as described in more detail later. Alternative to the above preferred embodiment, base E may take any form capable of receiving the inflation medium and aspirating the aspiration medium, both of which are entrained together and directed through the mixing tube assembly G and directed into an inflatable device.

In a preferred embodiment, mixing tube assembly G includes a telescopic mixing tube 90 with aspiration cavity 89 therein (shown in FIGS. 8–10) and a tube extension 92 with a bell or larger diameter end for fitting over tube 90 to connect the extension to tube 90. The mixing tube 90 has a spider bracket 93 attached within aspiration cavity 89 about the end opposite the a tube lip 142. The spider bracket has a center core with outward extending branches having voids therebetween and the branches are connected to the tube extension 92 in such a manner to allow both inflation and aspirated medium to flow in between the branches. Telescopic mixing tube 90 is slidable within outer container 72. However, fluid such as the inflation medium and the aspiration medium does not leak in between telescopic mixing tube 90 and outer container 72 because of a wiper annular ring 94 therebetween. Alternatively, mixing tube assembly G may take any form capable of telescoping within base E such that the aspiration medium is aspirated into the mixing tube 90 and mixed with the inflation medium only when inflation medium is being supplied to the regulator body 10.

Outer container 72 includes an outer cap 124, a container neck 126, and an annular ring mounting groove 128 (shown in FIGS. 6 and 7). Outer cap 124 and container neck 126 each have an aperture or passage therethrough defining a main bore for receiving injector body 66, aspirator piston assembly F, and telescopic mixing tube 90. This allows outer container 72 to be slipped over and thereby substantially enclose injector body 66 and aspirator piston assembly F when aspirator assembly A is fully assembled. In addition, telescopic mixing tube 90 slides along the inside of outer container 72 via the apertures in outer cap 124 and container neck 126.

In the preferred embodiment, wiper annular ring 94 is mounted in annular ring mounting groove 128 and functions as a seal prohibiting leakage of the mixed inflation and aspiration mediums between telescopic mixing tube 90 and outer container 72, even during telescoping of mixing tube 90 with reference to outer container 72. Specifically, wiper annular ring 94 is a circular or annular shaped rubber gasket made of buna n material. The cross section of wiper annular ring 94 is a "reclined L-shaped" as is shown more clearly in FIGS. 8, 9 and 10. Alternatively, and preferably, the annular ring is "U-shaped" as is shown in FIG. 18.

As to the "reclined L-shaped" embodiment, the wiper annular ring has a base 94A that is substantially rectangular in cross sectional shape, and an inwardly extending edge or wiper 94B that obliquely extends out from base 94A and tightly yet slidably seals to mixing tube 90. Specifically, this shape allows wiper annular ring 94 to gr mounted in "L-shaped" mounting groove 128 such that wiper 94 and specifically portion 94B tightly seals to mixing tube 90 yet allows mixing tube 90 to slide with respect to outer container 72 which fixedly holds wiper annular ring 94. The mixing tube is slid within the outer container based upon the application of inflation medium pressure against aspirator piston assembly F that overcomes the bias of the piston assembly as described below, and then slid again when the pressure can no longer continue to overcome said bias.

Figure 18:
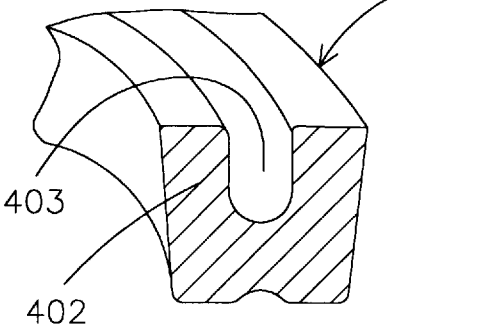
FIG. 18 is a cross sectional view of an alternative and preferred embodiment of the wiper annular ring embodied as a U-shaped annular ring rather than a reclined L-shaped annular ring.

As to the "U-shaped" embodiment, the wiper annular ring 94' is best shown in FIG. 18. The U-shaped annular ring 94' is a U-shaped body including a base 400 with walls 401 and 402 transversely extending therefrom. The base and walls define a center cavity 403. The mounting groove 128 is slightly modified to receive the U-shaped ring 94'. Specifically, the U-shaped ring may be mounted in several different manners including with the cavity 403 receiving a modified neck 126' as shown in one fashion in FIG. 18A and in another in FIG. 18B. Wiper annular ring may alternatively be any seal capable of sealing mixing tube 90 to outer container 72.

Figure 20:
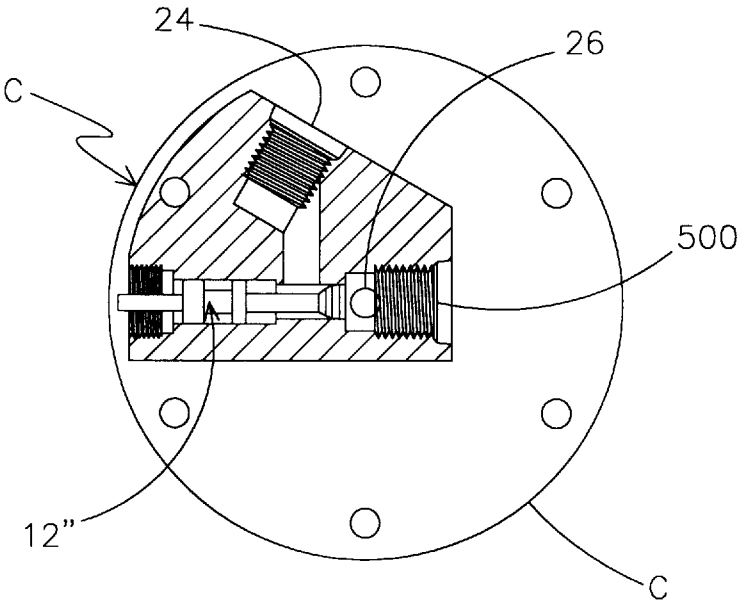
FIG. 20 is a cross sectional view of the regulator and inlet check housing unit as shown in FIG. 19.
Figure 19:
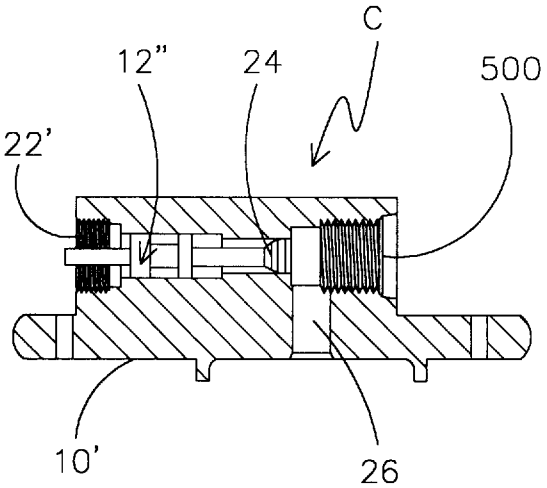
FIG. 19 is a sectional view of an even further alternative regulator and inlet check housing unit.

As is more clearly shown in FIG. 4, aspirator piston assembly F includes an aspirator piston 96 (or the alternative embodiment as shown in FIGS. 19–20 and described below), an aspirator piston spring 98, a poppet 100, a poppet spring 102, and a piston pin 104. Aspirator piston 96 has a shaft 106 and a head 108. Head 108 includes a poppet shaft seat 110 axially bored into the head, and a pin aperture 112 transversely cut through head 108 from the outer perimeter of the head to the poppet shaft seat 110.

Aspirator piston spring 98 slides over shaft 106 and seats on a spring support flange 114 that is defined as the point where head 108 connects with shaft 106. Poppet spring 102 slides over a poppet shaft 116 and one end rests against a poppet head 118 while the other end seats in poppet shaft seat 110 in aspirator piston 96.

The aspirator piston assembly F is assembled as follows, although the order of assembly and the parts used therein may take on other embodiments so long as the final product is an aspirator piston assembly for insertion into aspirator body D to restrict the flow of inflation medium from regulator mechanism C to mixing tube G and not vice versa. Poppet spring 102 is slid over poppet 100 and compressed so that all of poppet spring 102 is in between poppet head 118 and piston pin 104 when inserted into a poppet slot 122 in poppet shaft 116 as described below. The poppet shaft 116 is inserted into poppet shaft seat 110 in head 108 of piston 96 such that pin aperture 112 is aligned with poppet slot 122. Piston pin 104 is inserted and secured into both the pin aperture 112 and the poppet slot 122 thereby restricting movement of the poppet 100 with relation to the aspirator piston 96 to the length of the slot 122 and thus permanently compressing poppet spring 102 at least slightly. The result is that poppet 100 is slidable within the constraints of pin 104 within poppet slot 122 but is biased away from head 108 of piston 96 by at least slightly compressed spring 102.

The fully assembled aspirator piston assembly F includes aspirator piston spring 98 slid over shaft 106 of aspirator piston 96 such that one end of spring 98 seats against spring support flange 114. The aspirator piston assembly F is then insertable into passageway 84 of injector body 66.

The aspirator body D with the aspirator piston assembly F therein when assembled is connected together in the following manner, although any order of assembly may be used so long as the parts are properly assembled. Aspirator cap 62 of base E and inflation medium inlet B are separately fastened to regulator mechanism C. Specifically, aspirator cap 62 is fastened via screws 130 to regulator body 10 resulting in the alignment of outlet port 26 in regulator mechanism C with cap aperture 65 in aspirator cap 62 in a sealed manner due to seal H which in its preferred embodiment is an annular ring such as an o-ring. Also fastened to regulator body 10 via male and female threads is regulator cap 18 which compresses regulator spring 14 thereby biasing regulator piston 12 away from regulator post 16 and regulator cap 18. Inlet fitting 52 is also threaded to regulator body 10. The result is the inflation medium supply fastened at inlet fitting 52 to regulator body 10; the piston 12, spring 14, post 16 and cap 18 parts of regulator mechanism fastened at regulator port 22 to regulator body 10; and an exit for the regulated inflation medium via outlet port 26.

In sum, the aspirator assembly A is assembled by sealably connecting the regulator mechanism comprising regulator piston 12, regulator spring 14, regulator post 16, and regulator cap 18 to regulator port 22 in regulator body 10 as described above; inlet fitting 52 to inlet port 24 in regulator body 10 as described above where annular ring 54 is positioned in between and acts to seal fitting 52 and port 24 together; and aspirator body D to regulator body 10 using screws 130 inserted through screw apertures in aspirator cap 62 and into regulator body 10 such that outlet port 26 aligns with cap aperture 65.

In one embodiment as shown in FIGS. 5 and 8 the assembly of aspirator assembly A requires a number of seal, annular rings, o-rings, and gaskets to seal connected parts together thereby funneling all of the inflation medium and aspirated medium through the aspirator assembly without leaks which reduce the volume of medium expelled from the assembly and thus used to inflate the inflatable device the assembly is inflating. These seals, annular rings, o-rings, and gaskets include: head annular ring 46, backup annular ring 48, base annular ring 50, annular ring 54, wiper annular ring 94, injector gasket 132, housing annular ring 134, and cap sealing annular ring 140. In more detail, head annular ring 46, backup annular ring 48, and base annular ring 50 as described above are for sealing slidable piston 12 within passageway 28 in the regulator mechanism. Annular ring 54 as described above is for sealing inlet fitting 52 to regulator body 10. Cap sealing annular ring 140 seals injector plate 74 to aspirator cap 62 by guiding nubs 63 into plate aperture 76 and securing cap 62 to plate 74 using screws 146. Housing annular ring 134 is inserted in housing annular ring mounting groove 136 in passageway 84 of piston housing 82 for fluidly sealing the area between movable piston 96 and passageway 84 in piston housing 82 to prevent inflation or aspirated medium from leaking around piston 96. Injector gasket 132 is secured to injector plate 74 for providing a seal between tube lip 142 and injector plate 74 when tube lip 142 is biased against injector plate 74 by aspirator piston assembly F. Wiper annular ring 94 is inserted into wiper annular ring mounting groove 128 in outer container 72 for fluidly sealing the area between movable telescoping mixing tube 90 and fixed outer container 72.

The overall assembly of mixing tube G to injector plate 74 of aspirator body D involves the assembly of a number of parts in unison with the above described gaskets and seals. Aspirator piston assembly D as assembled above is inserted through plate aperture 76, passageway 80, and into passageway 84 where the aspirator piston 96 both extends out of piston housing 82 and is biased appositively due to spring 98 being compressed in between spring support flange 114 and ridge 148 in passageway 84. Cap sealing annular ring 140 is stretched over nubs 63 and aspirator cap 62 is fastened to injector plate 74 via screws 150 thereby seating biased poppet 100 in poppet head seat 64 to bias closed the fluid passageway from the inflation medium supply through inlet fitting 52, inlet passageway 30, inner cavity 20, outlet passageway 32, outlet port 26, cap aperture 65, and passageway 80 to injectors 88 at cap aperture 65 in poppet head seat 64.

Another needed assembly sequence involves assembling and connecting the mixing tube G to the base E. Telescopic mixing tube 90 with aspiration cavity 89 therein is positioned over injector body 66 such that tube lip 142 rests against injector gasket 132 fastened or resting against injector plate 74 resulting in piston 96 abutting spider bracket 93. Fastener 152 connects spider bracket 93 to piston 96. After wiper annular ring 94 is inserted in wiper annular ring mounting groove 128, screen 70 and outer container 72 are slid over telescopic mixing tube 90 with the plurality of support columns 68 positioned about the inner periphery of screen 70. Screws 154 connect outer cap 124 of outer container 72 to injector plate 74 by threading through outer cap 124 and support columns 68 into injector plate 74. Tube extension 92 is then attached to telescopic mixing tube 90.

Completion of the assembly of the aspirator assembly A results in an assembly as is shown in FIG. 9. Aspirator piston is spring 98, through its connection to telescopic mixing tube 90 via spider bracket 93 and based upon the constraints of ridge 148 and head 108 on the piston, biases telescopic mixing tube 90 such that tube lip 142 rests against injector gasket 132 on injector plate 74 thereby sealing off fluid flow between the outside atmosphere via screen 70 and aspiration cavity 89. Similarly, regulator spring 14 biases regulator piston 12 towards a stop 156.

When inflation medium is released from the inflation medium supply as is shown in FIG. 10, the inflation medium follows path 158 from the inflation medium supply through inlet fitting 52, inlet passageway 30, inner cavity 20, outlet passageway 32, outlet port 26, and to cap aperture 65 where the inflation medium pressure forces the poppet 100 out of poppet head seat 64 to allow the inflation medium to flow into plate aperture 76 and passageway 80 and thereby on to injectors 88 and out through aspiration cavity 89 to the inflatable device. The pressure on poppet 100 forcing it out of poppet head seat 64 compresses aspirator piston spring 98 thereby moving aspirator piston 96 and fixedly attached telescopic mixing tube 90. The moving of telescopic mixing tube 90 causes an opening to the outside atmosphere to appear in between the plurality of support columns 68 along the screen 70 resulting in the auctioning or aspirating of aspiration medium, i.e. air, into the aspirator where the aspiration medium is entrained in the inflation medium and forced into the inflation device.

After the inflation medium supply is drained and/or the inflatable device is fully inflated, the pressure against the poppet 100 and the piston 96 will subside and the poppet 100 and the piston 96 will spring back to the positions shown in FIG. 9 thereby sealing off the aspiration cavity 89 to prohibit the combined inflation and aspirated mediums now in the inflated device from flowing backwards and thus deflating the inflated device.

Wiper annular ring 94 seals the area between telescopic mixing tube 90 and outer container 72 thereby prohibiting the combined inflation and aspirated mediums now in the inflated device from escaping via leakage. As is shown in FIGS. 9 and 10, this area is the only remaining area for leakage since the outer wall 160 of the inflatable (or now inflated) device is sealably positioned in between outer cap 124 and the outwardly extending ridge on container neck 126 created by wiper annular ring mounting groove 128, and tube lip 142 has been biased against injector gasket 132.

Yet another alternative embodiment of the regulator mechanism C and specifically the regulator piston 12 is shown in FIG. 11 as regulator piston 12". In contrast to regulator piston 12 as shown specifically in FIGS. 3, 6A and 6B as having a uniformly tapered head 36 and the alternative piston 12' as shown in FIG. 8 as having a similar uniform tapered head that is longer as it replaces neck 38, piston 12" has a stepped tapered head 36" as best shown in FIG. 11. Specifically, the stepped tapered head includes multiple tapered surfaces, and in the embodiment shown in the FIGURES this is a first tapered surface 200", a second tapered surface 202", and a third tapered surface 204" where the first tapered surface is nearest parallel with a central axis 206" of the regulator piston 12" and the third tapered surface is nearest perpendicular with the central axis 206" of the regulator piston 12". The result is a head 36" that tapers more inward and closer to perpendicular as it extends from an end face 208" to the neck 38" thereby resulting in a rough appearance of a semi-spherical head with a flat end surface 208" as the outermost portion of the piston 12".

This stepped taper concept provides improved regulation of fluid flow of the primary gas into the aspirator. As a result, the aspiration is more controlled, even flowing, and longer lasting resulting in substantially improved aspiration. Alternatively, the stepped tapered head 36" may instead have either each tapered surface as a concave conical surface whereby the cumulation of the surfaces increases in curvature from the surface at the endface 208" to the surface adjacent the neck 38", or instead of stepping the tapered head may be one concave surface.

Figure 12:
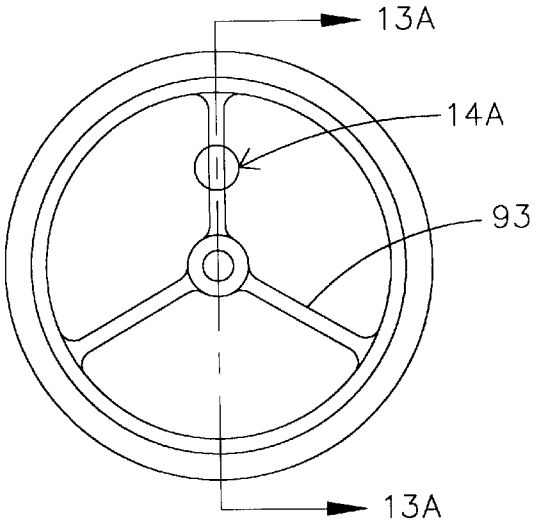
FIG. 12 is an end view of the mixing tube assembly.
Figure 13:
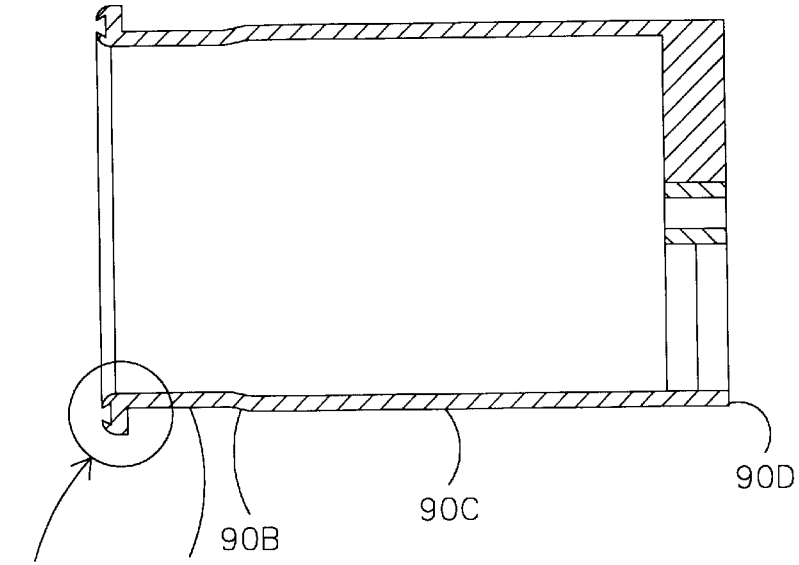
FIG. 13 is a cross section of the mixing tube assembly taken along lines 13A—13A in FIG. 13.

An alternative embodiment of mixing tube assembly G and specifically telescopic mixing tube 90 is shown in FIGS. 12 and 13 as tube 90'. Tube 90' includes a cylindrical portion 90A substantially adjacent the tube lip 142 and extending therefrom to a transition or taper area 90B where the cylindrical portion 90A is of an at least slightly reduced diameter in comparison to the other cylindrical portion 90C extending from the transition area 90B to the outermost end 90D of the tube 90'. This reduced diameter area 90A allows the tube 90' to slide open along the inner surface of container neck 126 without or with lessened drag of the wiper ring 94. As a result, the wiper ring 94 or 94' serves to tightly seal against surface 90C when the tube 90' is seated with its lip 142 against injector plate 74 while also sealing against surface 90A but to a lesser degree as the tube moves outward from plate 74 during aspiration. This reduced sealing is not a significant factor because it is only during aspiration where a tight seal between tube 90' and container 72 is not critical. This lessened or eliminated drag allows for much smoother and easier travel of the tube 90' and thus much more efficient aspiration.

Figure 14:
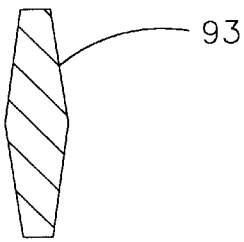
FIG. 14 is a cross sectional view of one of the spider brackets of FIG. 12.

FIG. 14A shows in cross section the spider bracket 93 and specifically the diamond cross section of each bracket. This diamond cross section provides for improved fluid flow during aspiration as fluid friction is reduced by the transitional nature of this design.

Figure 15:
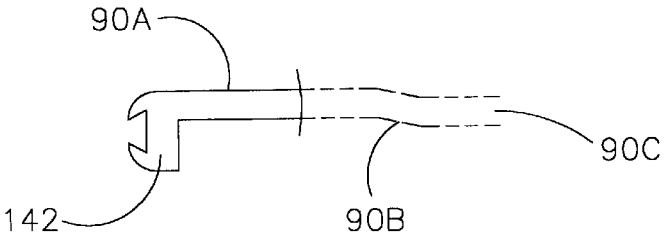
FIG. 15 is an enlarged view of the lip of the telescopic mixing tube.

FIG. 15A shows an enlarged view of the lip of one embodiment of the tube. The lip 142 includes a cavity 143 in its end face for holding a seal (not shown in this view). This seal held within cavity or groove 143 provides for proper positioning of the seal 132 as is necessary to assure proper sealing of the tube 90 or 90' to the injector plate 74 after aspiration thereby sealing off leaks which would deflate the aspirated inflatable device. This groove in cross section as shown in FIG. 15A is dove tailed so as to best hold the seal 132. FIG. 15A also shows in hidden or dashed lines, that extend out from the detail circle 15A, the transition 90B and surface 90A and 90C adjacent thereto.

Figure 16:
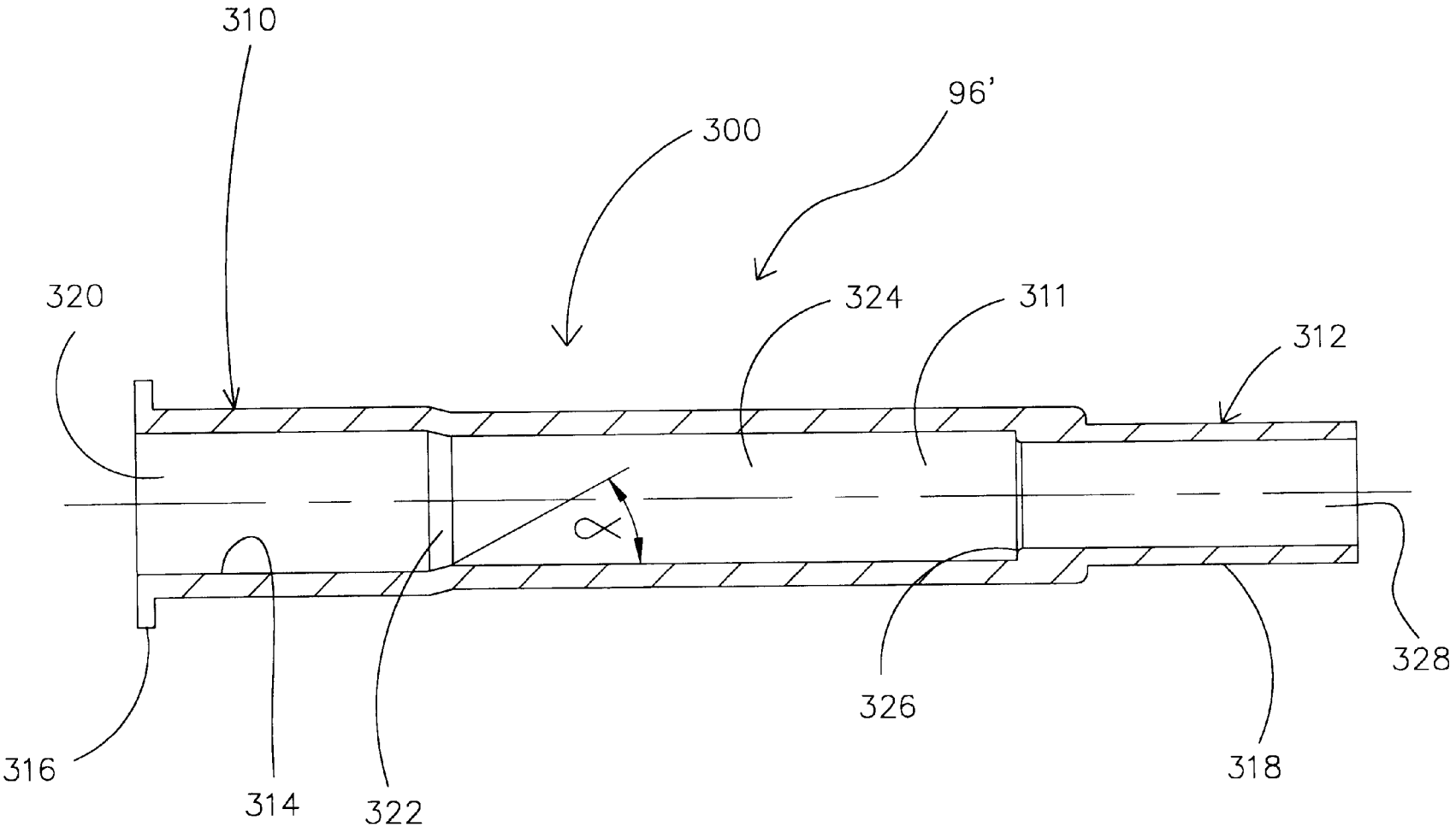
FIG. 16 is a sectional view of the outer piston of a second embodiment of the aspirator piston.
Figure 17:
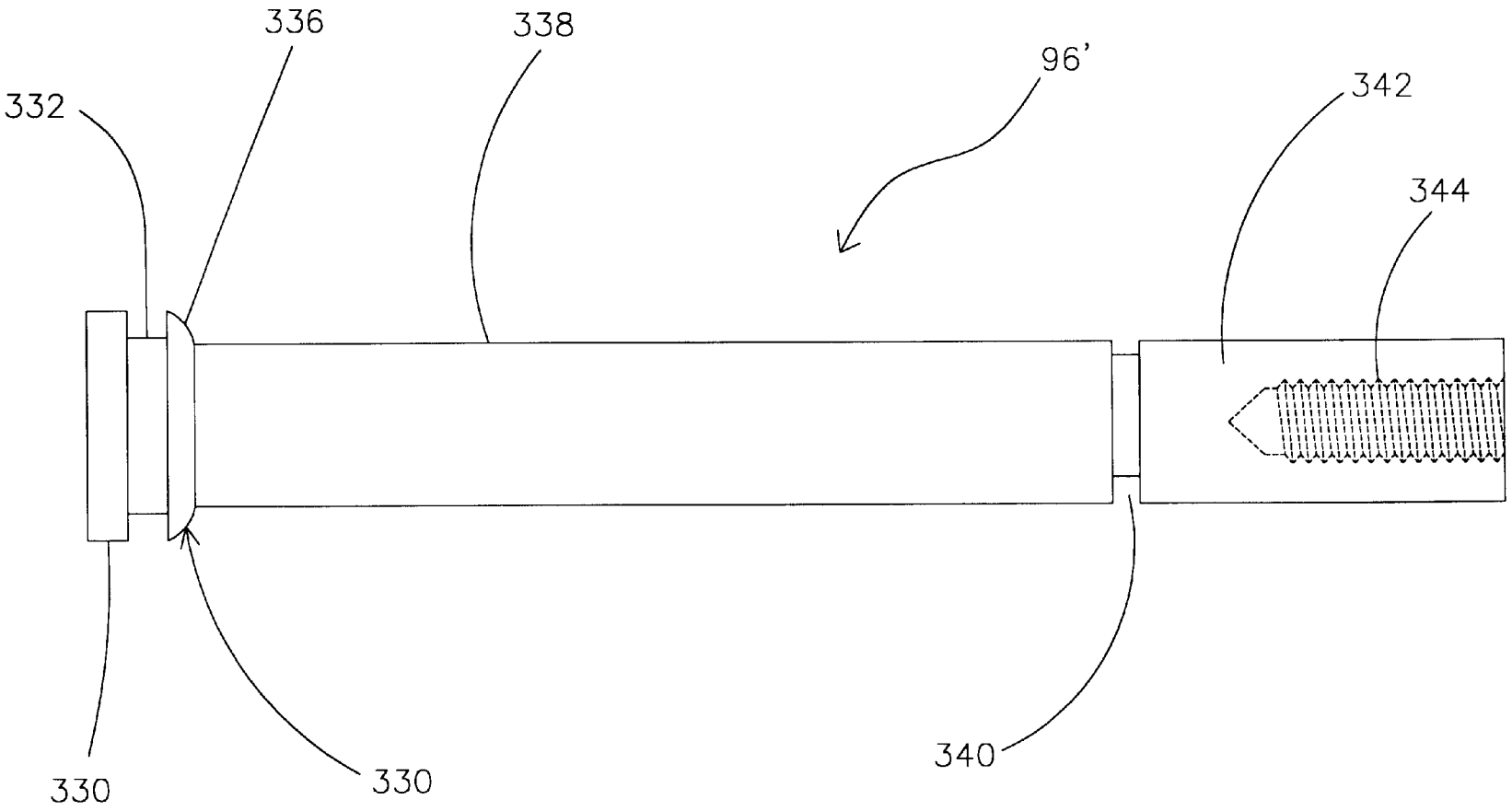
FIG. 17 is a sectional view of the inner piston of the second embodiment of the aspirator piston.

FIGS. 16 and 17 show an alternative and preferred embodiment of the aspirator piston 96 as piston 96' for use in aspirator piston assembly F. This aspirator piston 96' is a two piston or piece unit, namely outer piston 300 and inner piston 302. Outer piston 300 is a hollow sleeve 310 or cylinder that includes an inner cavity 311 extending from end to end for receiving the inner piston 302. In more detail, outer piston 300 includes an outer surface 312 and an inner surface 314. Outer surface 312 includes a lip 316 at one end of the piston 300 and a decreased diameter portion 318 at the other end. Inner surface 314 includes a largest diameter bore 320, a tapered shoulder 322, an intermediate diameter bore 324, a primarily radial shoulder 326 although its edges may be rounded, and a smallest diameter bore 328. Preferably, tapered shoulder is tapered as angle $\alpha$ at between 1° and 89° from the central axis although tapers in the range of between 5° and 45° and more preferably around 20°.

Inner piston 302 is generally solid in contrast to hollow outer piston 300. Inner piston 302 includes a head 330, a first neck 332, a collar 334 with a radiused or tapered edge 336, a second neck 338, a groove or slot 340, and a third neck 342 with a bore 344 in the end thereof The inner piston 302 is seated within the outer piston 300 which is positioned within aspirator piston assembly F whereby during initial pressure release to start aspiration, the inner piston 302 initially moves until collar 334 seats against tapered shoulder 322 thereby closing the inner cavity from fluid flow. Thereafter, outer piston 300 begins to move by overcoming its spring bias and provides a fluid flow path for providing primary fluid to the aspirator. Once the pressure of primary gas begins to diminish, the outer piston 300 springs back and the little piston 302 slams or rapidly returns to its initial position. This rapid returning results in very little, if not no, back leakage through the regulator in contrast to many prior art designs in which significant leakage occurs at first and then some leakage continues for some time.

In another embodiment, the regulator mechanism C is integral to the aspirator body D. In an even further embodiment, the regulator mechanism C' is of the design shown in FIGS. 19–20. In contrast to regulator body 10, regulator body 10' of mechanism C' includes a female thread for securing in the regulator piston 12, 12' or 12" rather than a male thread with an external cap 18. The body 10' includes an inlet port 24' for an inlet check valve, an outlet port 26' for fluid connection to the aspirator, and an additional port 500 in alignment with the inner cavity in which the regulator piston is housed and thus opposed to the regulator port 22'. The regulator assembly could be assembly 12, 12' or 12" and the related parts including spring 14, etc. although the displayed embodiment is that of regulator piston 12".

The invention has been described with reference to the preferred embodiment obviously, modifications and alterations will occur to others upon a reading and understanding of this specification. It is intended to include all such modifications and alterations insofar as they come within the scope of the appended claims or the equivalents thereof

What is claimed is:

1. An aspirator assembly for use in inflating an inflatable device comprising:

an outer body having a main bore with an inner surface and peripheral openings extending through the outer body;

a mixing tube telescopically positioned within the main bore and having an outer surface which includes a first diameter section and a second diameter section; and a seal fluidly sealing the outer surface of the mixing tube to the inner surface of the main bore in a manner permitting the mixing tube to telescope within the main bore while maintaining the fluid seal, and wherein seal is of a diameter that allows for reduced drag of the mixing tube against the main bore when the seal is adjacent the first diameter section while providing for sufficient sealing when the seal is adjacent the second diameter section.

2. The aspirator assembly as defined in claim 1 wherein the seal is a polymer seal of a non-uniform cross section.

3. The aspirator assembly as defined in claim 2 wherein the polymer seal is a rubber seal of at least one of a reclined L-shaped and a U-shaped cross section.

4. The aspirator assembly as defined in claim 1 wherein the seal is an annular ring of a U-shaped cross section.

5. The aspirator assembly as defined in claim 1 further comprising an injector gasket for fluidly sealing the mixing tube to the outer body when the mixing tube is in an unextended position resulting in the mixing tube sealing off the peripheral openings, and where lip functions to stop the mixing tube from telescoping further when the mixing tube is fully extended.

6. The aspirator assembly as defined in claim 1 further comprising an injector body positioned within the main bore and providing a passage therein through which a primary fluid flows during aspiration.

7. The aspirator assembly as defined in claim 6 wherein an aspirator piston is biased within the passage in a closed manner whereby the release of the primary fluid overcomes the bias and moves the piston to provide fluid flow into injector body and out air injectors therein into the mixing tube where aspiration occurs with a secondary fluid.

8. The aspirator assembly as defined in claim 7 wherein the aspirator piston is a first piston seated within a second larger piston.

9. The aspirator assembly as defined in claim 1 further comprising a regulator fluidly connected to an inlet in the outer body through which a primary fluid is provided for aspiration.

10. The aspirator assembly as defined in claim 9 wherein the regulator includes a spring biased regulator piston therein, the regulator piston including a tapered head.

11. An aspirator assembly for use in inflating an inflatable device comprising:

an outer body having a main bore with an inner surface and peripheral openings extending through the outer body;

a mixing tube telescopically positioned within the main bore and having a tube lip with a tube body extending therefrom and having an outer surface, the tube body having a first diameter section extending between the tube lip and a second diameter section which is of a larger diameter than the first diameter section; and a seal fluidly sealing the outer surface of the mixing tube to the inner surface of the main bore in a manner permitting the mixing tube to telescope within the main bore while maintaining the fluid seal.

12. The aspirator assembly as defined in claim 11 further comprising a taper connecting the first and second diameter sections.

13. The aspirator assembly as defined in claim 11 wherein the seal is a polymer seal of a non-uniform cross section.

14. The aspirator assembly as defined in claim 11 wherein the seal is an annular ring of a U-shaped cross section.

15. The aspirator assembly as defined in claim 1 further comprising an injector gasket for fluidly sealing the mixing tube to the outer body when the mixing tube is in an unextended position resulting in the mixing tube sealing off the peripheral openings, and where lip functions to stop the mixing tube from telescoping further when the mixing tube is fully extended.

16. An aspirator assembly for use in inflating an inflatable device comprising:

an outer body having a main bore with an inner surface and peripheral openings extending through the outer body;

a mixing tube telescopically positioned within the main bore and having an outer surface which includes a first diameter section and a second diameter section;

a seal fluidly sealing the outer surface of the mixing tube to the inner surface of the main bore in a manner permitting the mixing tube to telescope within the main bore while maintaining the fluid seal; and wherein the mixing tube includes the first diameter section and the second diameter section of a larger diameter whereby the seal and diameter sections are correlated such that the first diameter section is adjacent the seal during any telescopic movement of the mixing tube while the second diameter section is adjacent the seal when the mixing tube is biased closed.

17. The aspirator assembly as defined in claim 16 further comprising a taper connecting the first and second diameter sections.

18. The aspirator assembly as defined in claim 16 wherein the seal is a polymer seal of a non-uniform cross section.

19. The aspirator assembly as defined in claim 16 wherein the seal is an annular ring of a U-shaped cross section.

20. The aspirator assembly as defined in claim 16 further comprising an injector gasket for fluidly sealing the mixing tube to the outer body when the mixing tube is in an unextended position resulting in the mixing tube sealing off the peripheral openings, and where lip functions to stop the mixing tube from telescoping further when the mixing tube is fully extended.

* * * * *